US007530149B1

(12) United States Patent
Bobbitt

(10) Patent No.: US 7,530,149 B1
(45) Date of Patent: May 12, 2009

(54) LAWN CRYPT COVERING SYSTEM AND METHOD

(76) Inventor: Gary Bobbitt, 1590 Bonita Vista Dr., San Bernardino, CA (US) 92404

( * ) Notice: Subject to any disclaimer, the term of this patent is extended or adjusted under 35 U.S.C. 154(b) by 0 days.

(21) Appl. No.: 11/966,814

(22) Filed: Dec. 28, 2007

Related U.S. Application Data

(63) Continuation-in-part of application No. 11/029,633, filed on Jan. 4, 2005, now Pat. No. 7,337,585.

(51) Int. Cl.
*E02D 19/00* (2006.01)

(52) U.S. Cl. ..... 27/30

(58) Field of Classification Search ..... 27/30, 27/35; 52/128, 133, 139, 140; 428/17, 53
See application file for complete search history.

(56) References Cited

U.S. PATENT DOCUMENTS

| | | | | |
|---|---|---|---|---|
| 324,167 | A | 8/1885 | Robey | |
| 510,696 | A | 12/1893 | Mease | |
| 1,004,273 | A | 9/1911 | Johnson | |
| 1,773,865 | A | 8/1930 | Rothenberger | |
| 1,815,883 | A | 7/1931 | Davis | |
| 1,932,792 | A | 10/1933 | Loresch | |
| 2,015,889 | A | 10/1935 | Fineman | |
| 2,024,047 | A | 12/1935 | Kropp | |
| 2,034,633 | A | 3/1936 | Roberts | |
| 2,347,440 | A | 4/1944 | Skolnik | |
| 2,913,895 | A | 11/1959 | Blasius et al. | |
| 3,157,557 | A | 11/1964 | Palmer | |
| 3,230,674 | A | 1/1966 | Christensen | |
| 3,295,271 | A | 1/1967 | Dorris | |
| 3,390,044 | A * | 6/1968 | Malakoff | 428/17 |
| 3,565,742 | A | 2/1971 | Stephens et al. | |
| 3,581,452 | A | 6/1971 | Jalbert | |
| 3,616,104 | A * | 10/1971 | Kuzmick | 428/17 |
| 3,661,687 | A | 5/1972 | Spinney et al. | |
| 3,722,155 | A | 3/1973 | Glock et al. | |
| 3,735,988 | A * | 5/1973 | Palmer et al. | 473/162 |

(Continued)

FOREIGN PATENT DOCUMENTS

DE 3150023 A1 6/1983

(Continued)

OTHER PUBLICATIONS

"Double-Depth Lawn Crypts" by Fraser Way Prekast. 2 pages. http://www.bannertown.com/lawn_crypts.htm.

(Continued)

*Primary Examiner*—William L. Miller
(74) *Attorney, Agent, or Firm*—Knobbe, Martens, Olson & Bear LLP

(57) ABSTRACT

A lawn crypt covering system that provides a substantially continuous exterior surface between adjacent crypts is disclosed. The covering system includes a plurality of crypt lid covering and at least one insert that slidably engages with the crypt lid coverings of two adjacent crypts. The insert interlocks with the two crypt lid coverings, thereby covering the gap between the two crypts and provides a stable support surface to people to walk on without getting the heel of the shoe stuck in the gap. The interlocking mechanism allows a side edge of the insert to mate with a side edge of each crypt lid covering.

5 Claims, 11 Drawing Sheets

U.S. PATENT DOCUMENTS

| | | | | |
|---|---|---|---|---|
| 3,772,826 | A | 11/1973 | Ferver | |
| 3,897,663 | A | 8/1975 | Gaul | |
| 3,958,378 | A | 5/1976 | Omeechevarria | |
| 3,978,627 | A | 9/1976 | Booth | |
| 4,064,664 | A | 12/1977 | Gaul | |
| 4,102,098 | A | 7/1978 | Duwe | |
| 4,128,981 | A | 12/1978 | Juba | |
| 4,162,289 | A | 7/1979 | Gomez et al. | |
| 4,200,964 | A | 5/1980 | Freitag | |
| 4,242,389 | A | 12/1980 | Howell | |
| 4,436,779 | A * | 3/1984 | Menconi et al. | 428/169 |
| 4,648,219 | A | 3/1987 | Johnston, Sr. | |
| 4,755,401 | A * | 7/1988 | Friedrich et al. | 428/17 |
| 4,950,519 | A * | 8/1990 | Huang | 428/44 |
| 5,375,940 | A | 12/1994 | Kobayashi | |
| 5,634,311 | A | 6/1997 | Carlton | |
| 5,740,637 | A | 4/1998 | Snow | |
| 5,746,030 | A | 5/1998 | Sannipoli, Sr. | |
| 5,894,699 | A | 4/1999 | Fulton et al. | |
| 6,105,315 | A | 8/2000 | Stoecklein et al. | |
| 6,176,317 | B1 | 1/2001 | Sepich | |
| 6,243,997 | B1 | 6/2001 | Sannipoli | |
| 6,324,793 | B1 | 12/2001 | Klanke | |
| 6,370,745 | B1 | 4/2002 | Kele et al. | |
| 7,273,642 | B2 * | 9/2007 | Prevost | 428/17 |
| 2002/0029515 | A1 * | 3/2002 | Prevost | 47/1.01 F |
| 2004/0211129 | A1 | 10/2004 | Sannipoli, Sr. et al. | |

FOREIGN PATENT DOCUMENTS

| | | |
|---|---|---|
| WO | WO 91/04381 | 4/1991 |

OTHER PUBLICATIONS

Whited Cemetery Service, Lawn Crypts, 1999, Romoland, California.

* cited by examiner

LAWN CRYPT COVERING SYSTEM AND METHOD

RELATED APPLICATIONS

This application is a continuation-in-part of U.S. application Ser. No. 11/029,633, filed on Jan. 4, 2005, now U.S. Pat. No. 7,337,585, issued on Mar. 4, 2008, which is hereby incorporated by reference in its entirety.

BACKGROUND OF THE INVENTION

1. Field of the Invention

This invention relates generally to below ground burial structures, and more particularly, to a lawn crypt covering system.

2. Description of the Related Art

In an effort to conserve cemetery space, the traditional practice of excavating individual grave sites for interment of each casket has been gradually replaced by the use of lawn crypts. Lawn crypts generally refer to an array of burial vaults installed below ground and positioned side-by-side in rows. Each crypt is typically a rectangular, concrete enclosure that may be of single or double depth and configured to enclose one or more caskets therein. The crypts are usually spaced in close proximity to one another to provide efficient use of cemetery space.

The lawn crypts are typically covered by concrete lids configured to fit over the opening of the crypt. The crypt lids are in turn covered by soil and lawn that are flush with the ground. A double depth lawn crypt is described in U.S. Pat. No. 5,746,030 to Sannipoli, while a modified lid for such a crypt, incorporating a headstone support, is described in U.S. Pat. No. 6,243,997, the entirety of each of which is hereby incorporated by reference.

One problem associated with cemeteries utilizing conventional lawn crypts is that a large amount of digging has to take place during each interment when access to the crypt is needed. This often involves driving heavy earth moving equipment over the lawn to the grave site, which often damages the grass. It also usually requires digging down 12 to 18 inches below grade level to expose the lid of the crypt and then replace the dirt and lawn over the crypt lid when the burial procedure is complete. It can be appreciated that removing and replacing lawn and soil are very labor intensive and costly processes. While artificial turf materials have been developed to cover lawn crypts such as that disclosed in U.S. Pat. No. 3,722,155, these coverings are usually large sheets anchored adjacent to the edges of pathways surrounding the crypts. Since each sheet typically extends across several crypt lids, the sheet removal process is more cumbersome and labor intensive. Moreover, these coverings are typically permanently attached to the surface of the crypt lid by an adhesive or tape, which makes replacement of the covering very difficult if not impossible.

In view of the foregoing, there is a need for an improved covering system for lawn crypts which permits easy and convenient attachment and removal of the covering.

SUMMARY OF THE INVENTION

In one embodiment, the present invention provides a lawn crypt covering system adapted to provide a substantially continuous exterior surface over adjacent lawn lids. The system comprises a plurality of crypt lid coverings, wherein each crypt lid covering is sized to cover at least a portion of a crypt lid. The system further comprises an insert, wherein the insert is adapted to be positioned between two crypt lid coverings and sized to cover the gap between the crypt lids which the crypt lid coverings are disposed thereon. The system further comprises an interlocking mechanism adapted to removably secure the insert between the two crypt lid coverings in a manner such that the insert and the two crypt lid coverings form a substantially continuous exterior surface. In a preferred implementation, the interlocking mechanism comprises a protrusion on one edge of the insert and a recessed area on an edge of the crypt lid covering. The insert and crypt covering are fitted together edge to edge by inserting the protrusion on the insert into the recessed area of crypt lid covering.

In another implementation, each crypt lid covering has an overhang that preferably extends along at least one side edge of the covering. Additionally, the insert has an indent that preferably extends along at least one side edge of the insert. Preferably, the interlocking mechanism comprises slidably engaging the overhang on the crypt lid covering with the indent on the insert in a manner such that the crypt lid coverings abut the insert.

In another embodiment, the present invention provides a lawn crypt covering system. The system comprises a crypt having a mounting surface attached thereto. The mounting surface is preferably configured to receive a fastener. The system further includes a covering having a lightweight base support and a layer of artificial lawn attached thereto. Preferably, at least one fastener is configured to attach the covering to the mounting surface on the crypt so as to secure the covering to the crypt. In one implementation, the crypt comprises a crypt lid having one or more recessed areas. Preferably, the mounting surface is formed in the recessed. In certain implementations, the recessed area extends inwardly from at least one edge of the crypt lid for about ⅜ inch. In one implementation, the mounting surface is preferably nailable and the support base is made of a water resistant, composite material selected from the group consisting of fiberglass, FRP, ABS, PVC, and combinations thereof. In another implementation, bolts are positioned on an upper surface of the crypt lid and extend through the covering to facilitate removal of the lid without disturbing the covering. In some implementations, a grave identification plate and vase holder, preferably made of granite or bronze, can be formed on an upper surface of the crypt lid. In certain preferred implementations, the system further includes a leveling device such as a shim that is positioned between the base support and the crypt lid to adjust for settling of the crypt.

In yet another embodiment, the present invention provides a lawn crypt covering system. The system comprises a lawn crypt lid having an upper surface comprising at least one recessed area. The recessed area is configured to receive a mounting structure, which provides a mounting surface for a fastener. The system further includes a covering comprising a man-made material resembling grass, wherein the covering is removably attached to the mounting structure via the fastener. In one implementation, the recessed area is formed on the outer periphery of the upper surface of the crypt lid. In another implementation, the mounting structure comprises an elongated, hollow material extending along the recessed area. Preferably, the fastener is selected from the group consisting of nails, screws, snaps, and clips.

In yet another embodiment, the present invention provides a method of covering a lawn crypt. The method includes attaching a mounting structure to the lawn crypt wherein the mounting structure is configured to receive a fastening device. Preferably, the mounting structure is substantially flush with an upper surface of the crypt. The method further includes forming a covering comprising an artificial lawn attached to a support base and securing the covering to the crypt by removably attaching the fastening device to the mounting structure. In one implementation, the fastening device is extended through the covering into the mounting structure. Preferably, the mounting structure is attached to a crypt lid.

In yet another embodiment, the present invention provides a lid for covering a lawn crypt. The lid comprises a generally rectangular member configured to cover an upper opening of the lawn crypt. Preferably, the rectangular member has at least one region that is recessed relative to a top surface of the lid. In one implementation, the recessed region is configured to receive a mounting device for securing a cover to the top surface of the lid. In another implementation, the recessed region extends along the outer periphery of the rectangular member. In certain implementations, the rectangular member comprises at least two discrete sections, wherein the sections are positioned adjacent to each other and each section can be moved independently of the other section.

DETAILED DESCRIPTION OF THE PREFERRED EMBODIMENT

Figure 1:
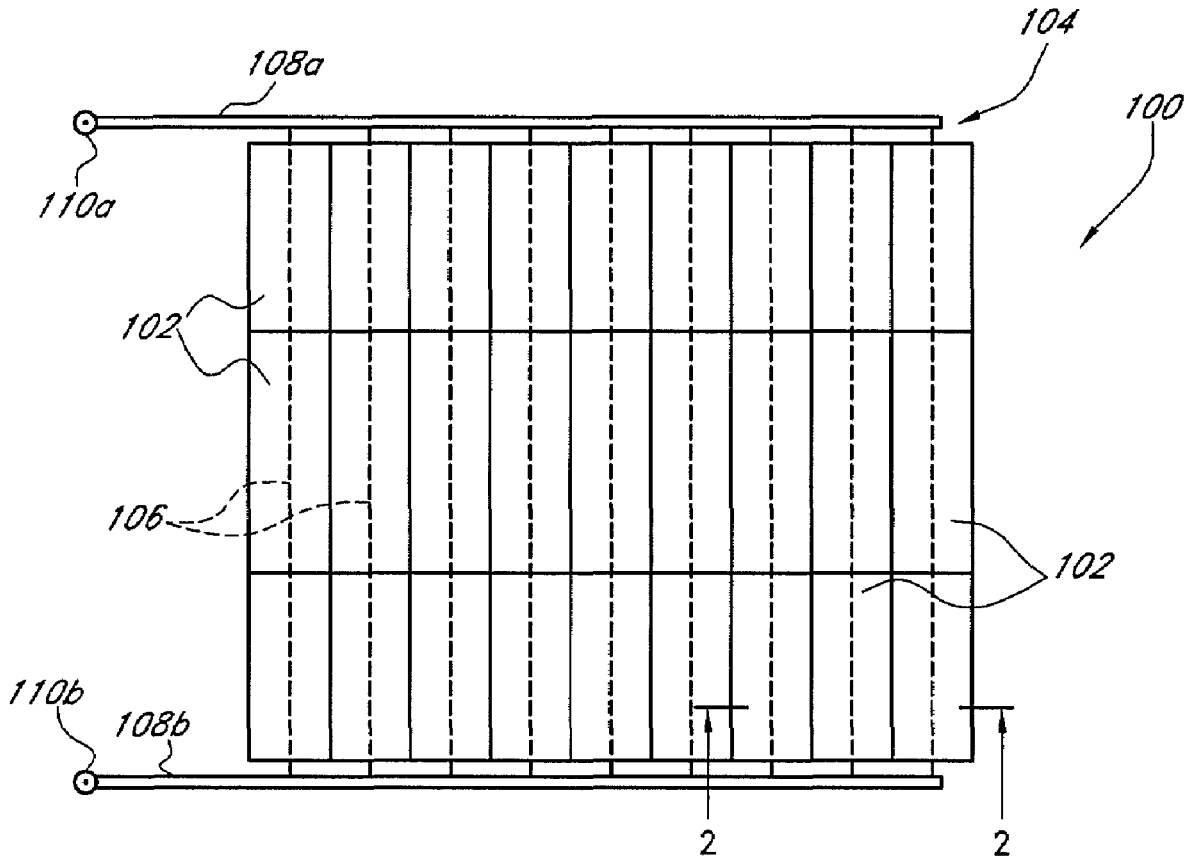
FIG. 1 is a schematic illustration of a lawn crypt system according to a preferred embodiment of the present invention.

References will now be made to the drawings wherein like numerals refer to like parts throughout. FIG. 1 is a schematic illustration of a lawn crypt system 100 according to one preferred embodiment of the present invention. The illustrated system is for a multiple burial site with a plurality of lawn crypts, but it will be understood that the same system may be applied to a single or family burial site, such as a family estate containing one or two crypts. As shown in FIG. 1, the lawn crypt system 100 includes a plurality of single or double depth crypts 102, or a mixture of single and double depth crypts, buried in a single hole dug into the earth to a predetermined depth, and arranged in an array of rows of crypts positioned side-by-side in each row. A suitable drainage system 104 for liquids and gases may be embedded in the ground prior to placement of the crypts 102. In one embodiment, the system 100 includes a series of perforated pipes 106, each pipe running under a line of crypts 102 as indicated in FIG. 1. Opposite ends of each pipe 106 are preferably connected to inlet and outlet pipes 108*a*, 108*b* running along opposite ends of the array. In some implementations, vertical stand pipes 110*a*, 110*b* preferably at least ten feet in height are connected to the end of each pipe 108*a*, 108*b* at a distance from the array of lawn crypts for allowing venting of gases.

Figure 2:
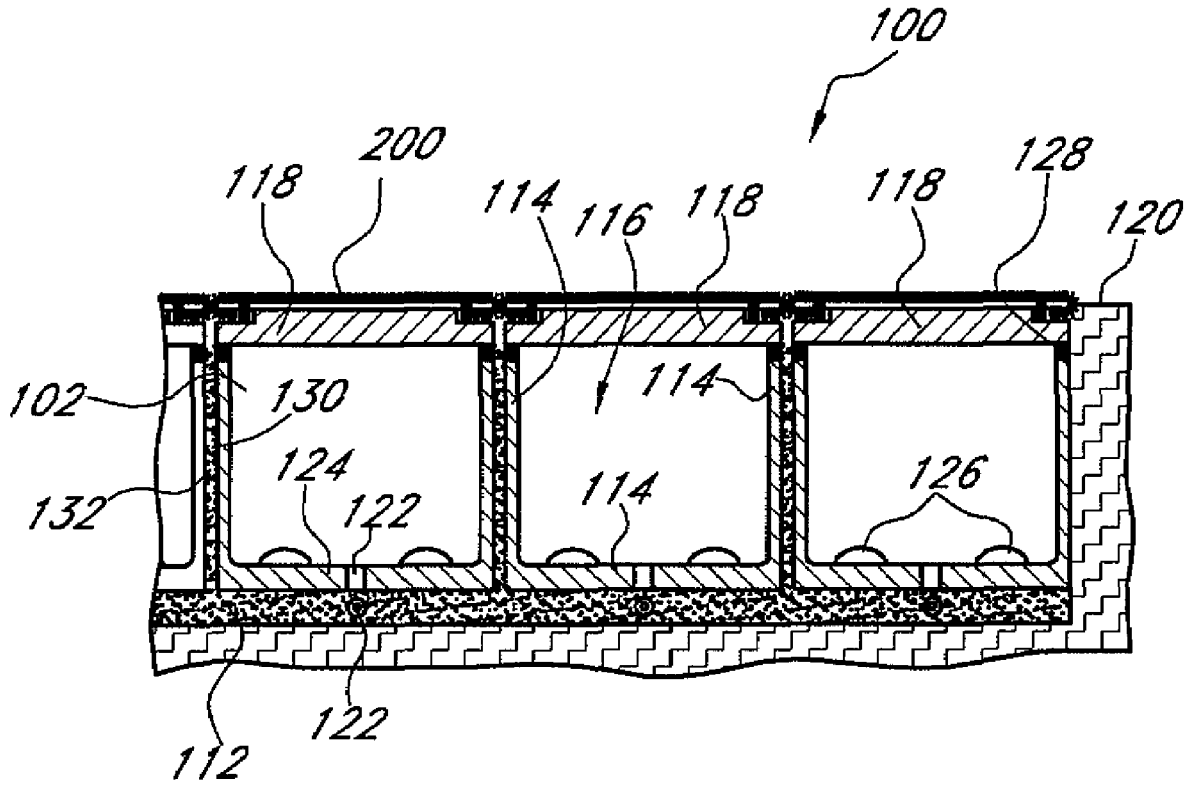
FIG. 2 is a cross-section view of the lawn crypt system of FIG. 1.

FIG. 2 provides a cross-section view of the lawn crypt system 100. As shown in FIG. 2, a layer of porous fill material 112 such as gravel can be placed into the bottom of the hole before lowering in the crypts 102. Each crypt 102 comprises a plurality of walls 114 arranged to form an enclosure 116 and a crypt lid 118 configured to cover the enclosure 116. The crypt walls 114 and lids 118 are preferably made of a strong and durable material such as concrete. In certain preferred embodiments, the crypt lids 118 are substantially at grade level 120 when installed and are configured to facilitate mounting as well as removal of a man-made covering material.

In the embodiment shown in FIG. 2, each crypt has two spaced drain holes 122 in its base 124, and typical gasket risers 126 are also provided on the base. In the case of a double depth lawn crypt, a suitable panel will be positioned approximately half way up the crypt for supporting a second casket, as described in U.S. Pat. No. 5,746,030 cited above. A sealing gasket 128 of rubber or the like can be provided between the upper end of the crypt walls 114 and the lid 118, for preventing or limiting leakage of gases upwardly out of the crypt in the cemetery area. Alternatively, instead of using the sealing gasket 128, each lid 118 may be permanently secured to the upper end of the crypt 102 after the final interment. The lid 118 may be secured by a suitable non-porous bonding material to substantially deter escape of gases in an upward direction. This also helps to ensure that any such gases will be directed along the pipes 106, 108*a*, 108*b* to the outlet stand pipes 110*a*, 110*b*. As also shown in FIG. 2, the crypts 102 are positioned with a small gap 130, preferably of the order of half an inch, between adjacent crypts in each row. The gap 130 can be filled with a non-porous fill material 132 such as sand and/or gravel to further limit upward escape of any gas resulting from decomposition.

Figure 3A:
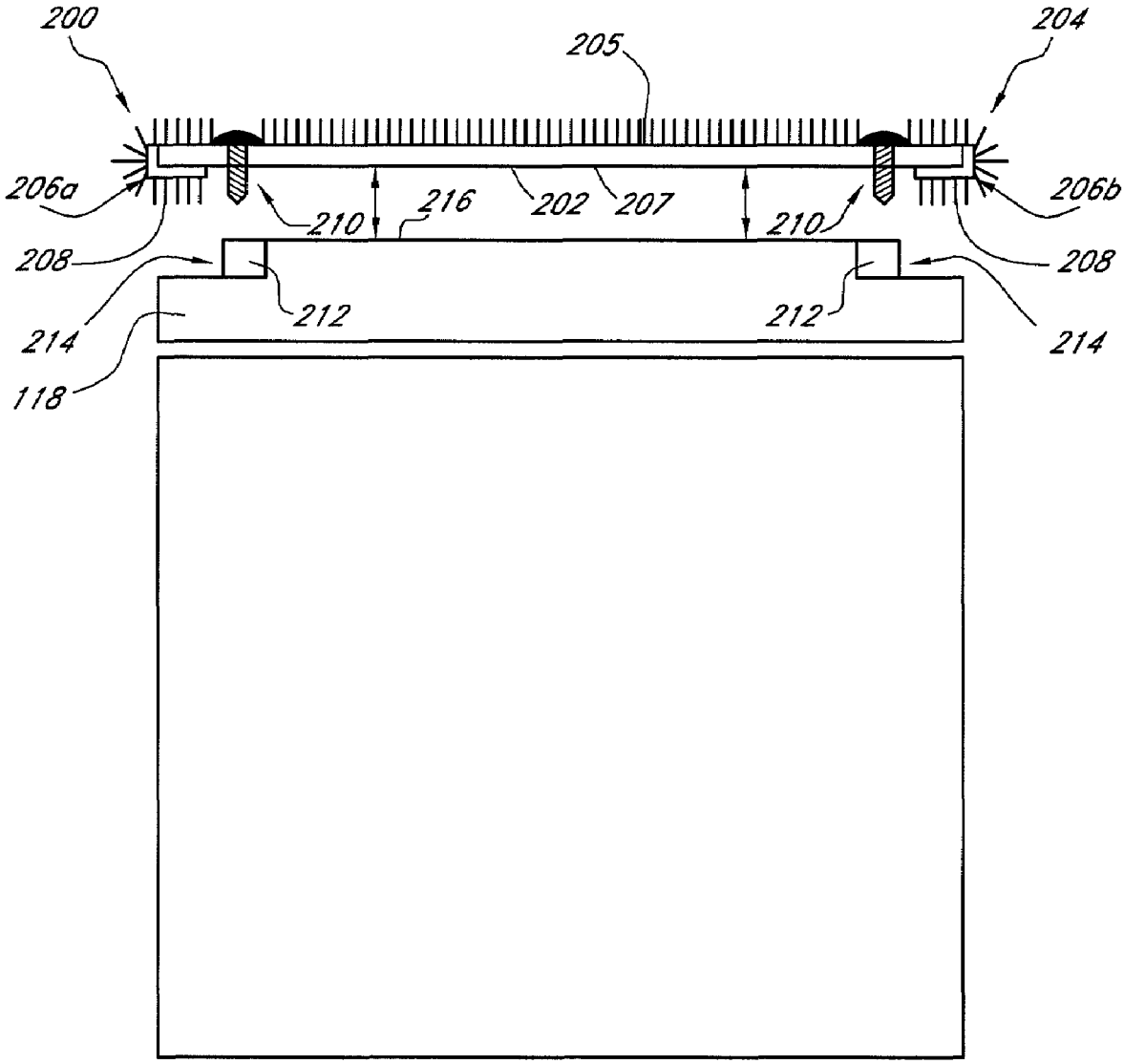
FIG. 3A illustrates a lawn crypt covering system of a preferred embodiment being installed on a crypt lid of a preferred embodiment of the present invention.

As also illustrated in FIG. 2, the lawn crypt system 100 further includes a covering system 200 designed to provide the exposed crypt lid 118 with an appearance that blends in with the surrounding. FIG. 3A shows the covering system 200 as generally including a base support 202 and a layer of artificial lawn 204 positioned thereon. Artificial lawn as used herein shall refer to a variety of different man-made materials including but not limited to artificial turf, man-made grass, sand, pebbles and the like. The base support 202 is preferably a lightweight, rigid material such as a plastic or composite board made of a material such as fiberglass, polyvinylchloride (PVC), acrylonitrile butadiene styrene (ABS), fiber reinforced plastic (FRP), or combinations thereof. In one embodiment, the layer of artificial lawn 204 extends across an upper surface 205 of a fiberglass board 202 and is wrapped around opposing side edges 206*a*, 206*b* of the board in a manner such that a portion 208 of the artificial lawn 204 contacts a lower surface 207 of the board 202. In a preferred implementation, the portion 208 of the artificial lawn 204 is affixed to the lower surface 207 of the board 202 via an adhesive or staples so as to secure the artificial lawn 204 to the board.

As FIG. 3A further illustrates, the covering system 200 also includes a plurality of fasteners 210 extending through both the artificial lawn 204 and the underlying base support 202 so as to further secure the artificial lawn 204 to the base support 202. As will be described in greater detail, the fasteners 210 are preferably adapted to attach to mounting structures formed on the crypt lid 118 so as to attach the covering system to the crypt lid 118. In one embodiment, the base support 202 is configured with a slight curvature in the center such that water coming in contact with the crypt lid will be drained off to the sides into a gravel-based drainage system as shown in FIGS. 1 and 2. Preferably, all materials used in the covering system as well as the fastener are made of water resistant materials.

As will be described in greater detail below, in certain embodiments, the covering system in conjunction with the unique crypt lid design permits the covering to be easily mounted and removed from individual crypt lids. FIG. 3A shows the crypt lid 118 as comprising a generally rectangular slab having recessed areas 214 formed thereon. In one embodiment, the recessed areas 214 are elongated channels or grooves extending along the edges of the slab. Additionally, the lid 118 also includes a plurality of mounting structures 212 adapted to receive the fasteners 210 of the covering system 200. Preferably, the mounting structures 212 are placed in the recessed areas 214 formed on the crypt lid. In one embodiment, the crypt lid 118 has a plurality of recess areas 214 formed on its upper surface 216. In some preferred embodiments, the entire outer periphery of the crypt lid 118 is recessed relative to the top surface of the lid. In certain embodiments, the mounting structures 212 are elongated plastic or wooden bars that are nailable and/or contain pre-drilled holes for receiving the fastener. As such, the covering system 200 can be repeatedly attached to and removed from the crypt lid via the fastener and the special configuration of the crypt lid.

Figure 3B:
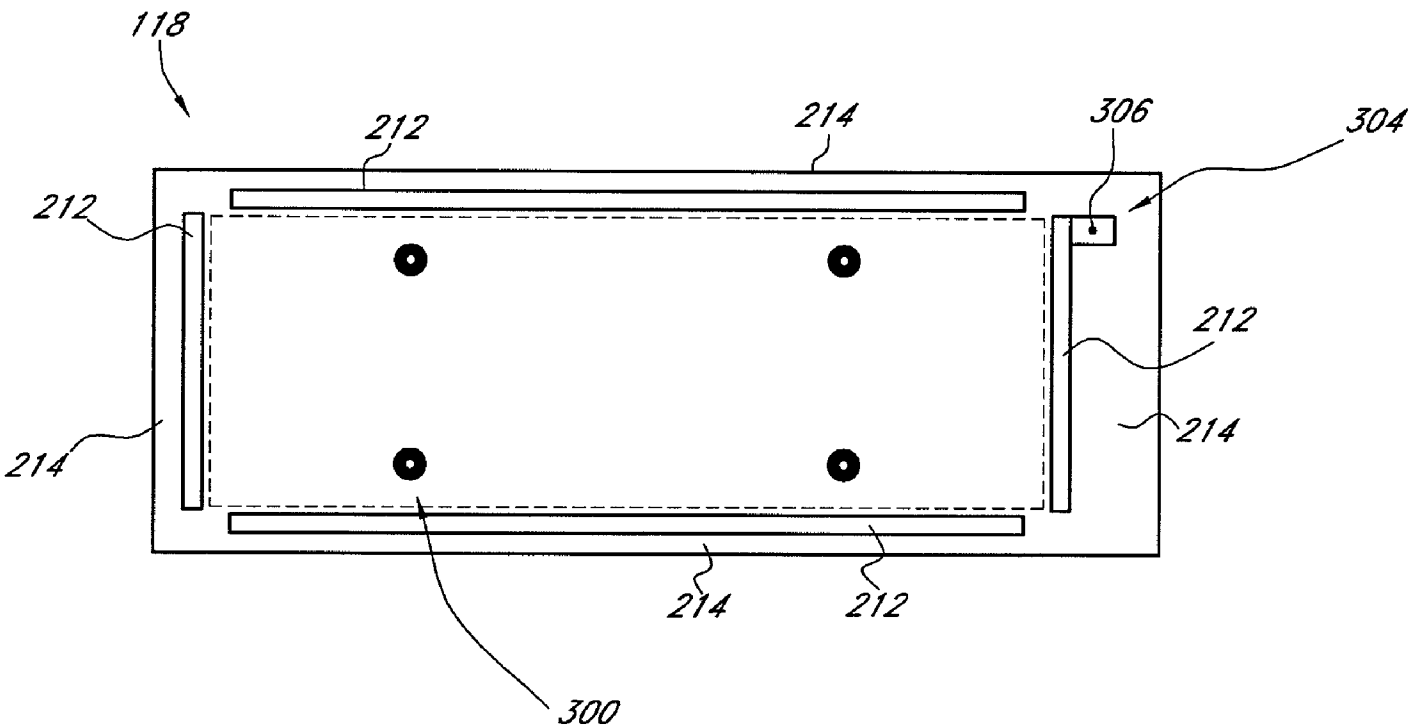
FIG. 3B is a top view of a lawn crypt lid of one preferred embodiment.

FIG. 3B is a top view of the crypt lid 118, showing the recessed areas 214 being formed along the outer periphery of the lid 118. In one embodiment, the crypt lid 118 has at least one edge that is recessed about ⅜ inch. However, it will be appreciated that the crypt lid can have recessed regions of a variety of different dimensions without departing from the scope of the invention. FIG. 3B also shows one or more elongated hollow mounting structures 212 extending along the recessed areas 214. It will be appreciated that the mounting structures 212 do not have to extend the entire length of any recessed area 214 nor does it have to be hollow. For example, the mounting structures 212 can be positioned at pre-selected locations in the recessed areas 214. In certain embodiments, the crypt lid 118 also has a plurality of lifting bolts 300 formed on its upper surface 216 to facilitate removal of the crypt lid without disturbing the covering system 200 attached thereto. In one embodiment, corresponding openings can be formed in the covering system to accommodate the lifting bolts. In other embodiments, a grave identification plate 304 and vase holder 306 can also be formed on the crypt lid 118. Preferably, the grave plate and vase holders are made of granite and/or bronze. In yet other embodiments, the crypt lid 118 is divided into at least two, preferably three, discrete sections that are positioned adjacent each other. Each individual section is independently movable relative to the other sections so as to facilitate removal and mounting of the crypt lid.

Figure 4:
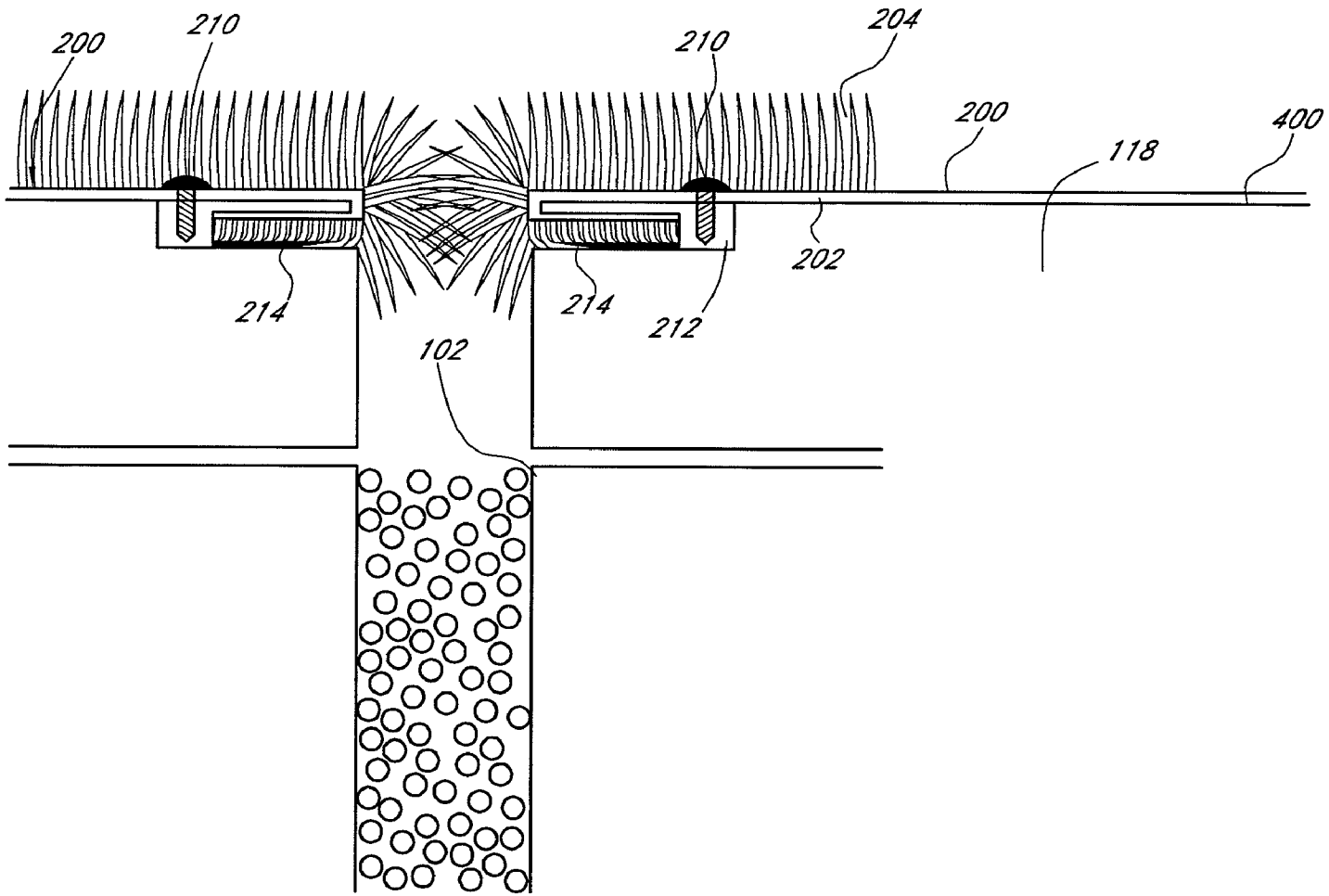
FIG. 4 illustrates an installed lawn crypt covering system of one preferred embodiment of the present invention.

When installed, the covering system 200 is attached to the crypt lid 118 as shown in FIG. 4. The fasteners 210 are inserted through the base support 202 of the covering system 200 into the mounting structure or nailable portion 212 of the crypt lid 118. Additionally, the recessed areas 214 of each crypt lid 118 provide a space for positioning the portion of artificial lawn 204 that wraps over the sides of the support base 202 of the covering. As such, the recessed areas 214 add strength to the bonding of the artificial lawn 204 to its base support 202. In some implementations, a shim 400 can be inserted between the lid 118 and the covering system 200 as a leveling device used to adjust for settling of the crypt 102 below the level of adjoining crypts over time. Additionally, the fasteners 210 preferably can also be adjusted to accommodate the thickness of the shim 400. Advantageously, the shim 400 can be inserted underneath the covering system 200 as a leveling device without having to remove the covering.

Figure 5:
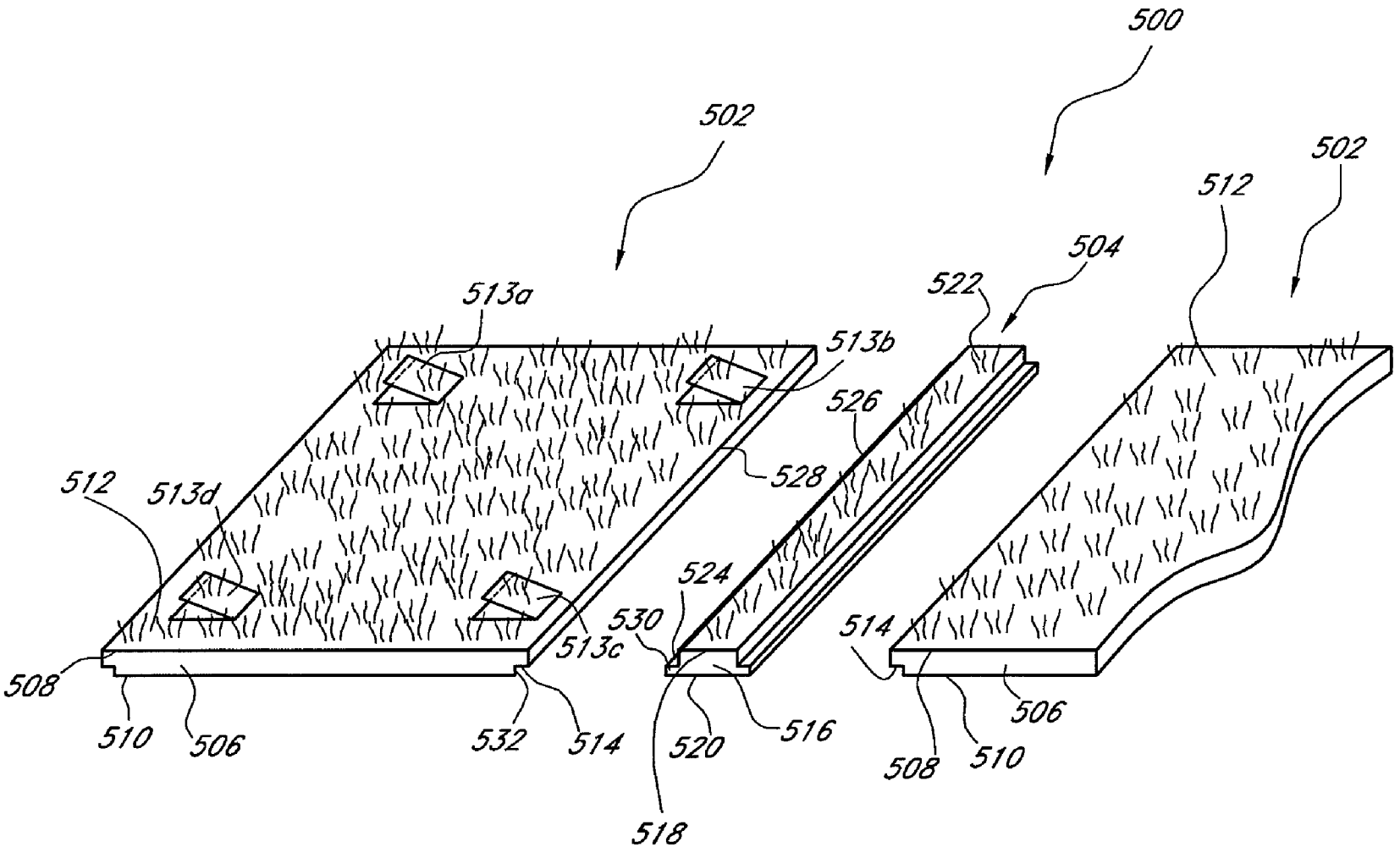
FIG. 5 schematically illustrates a lawn crypt lid covering system of another embodiment.

FIG. 5 illustrates a crypt lid covering system 500 of yet another embodiment of the present invention. The crypt lid covering system 500 shown in FIG. 5 generally comprises one or more substantially rectangular crypt lid coverings 502 and one or more elongate inserts 504. The inserts 504 are adapted to join adjacent crypt lid coverings 502 via an interlocking mechanism so as to form a substantially continuous exterior covering over a plurality of crypt lids and yet still allow easy removal of individual crypt lids without having to dismantle coverings on adjacent crypt lids.

As shown in FIG. 5, each crypt lid covering 502 comprises a base support 506 having an upper surface 508 and a lower surface 510. Each crypt lid covering 502 further comprises a layer of artificial lawn 512 attached to the upper surface 508 of the base support 506. The artificial lawn 512 can be attached by adhesives, nails, bolts, or other methods known in the art. In some embodiments, the crypt lid covering 502 comprises a plurality of cut-outs 513 *a-d* for grave markers, vase holders and the like. Preferably, each cut-out 513 *a-d* has three sides that are substantially cut through and one side that is preferably about 90% cut through. In one embodiment, the cut-outs preferably remain on the crypt lid covering until such time that a grave marker is to be installed. Once a grave marker is to be installed, the cut-out can be snapped out of the crypt lid covering system and the artificial lawn layer over the cut-out removed. The grave marker is preferably secured to the cut-out with an adhesive. The cut-out and the grave marker are preferably attached directly to the crypt lid with screws or other known fasteners. Preferably, each crypt lid covering 502 is sized to cover a conventional lawn crypt lid. The base support 506 can be made of a variety of different materials, such as a single lightweight plastic board or a plurality of lightweight plastic boards stacked, laminated or otherwise attached together. In one embodiment, the base support 506 is made of polyvinyl chloride (PVC) material. In another embodiment, the base support is made of one or more Sintra boards.

In a preferred embodiment, each crypt lid covering 502 has an overhang 514 that desirably extends along the length of at least one side of the base support 506. In another preferred embodiment, an overhang extends along the length of a pair of opposing sides of the base support 506. In yet another preferred embodiment, an overhang extends along the length of all four sides of the base support 506. In one implementation, the overhang 514 has a width of between about 0.1 inch to 1 inch, between about 0.5 inch to 2 inches. It will be appreciated that the overhang 514 can assume a variety of different dimensions and configurations without departing from the scope of the present invention. Preferably, the overhang 514 is adapted to mate with an edge of the insert 504 via an interlocking mechanism which detachably secures the insert between adjacent crypt lid coverings, thereby covering the gap between adjacent crypts.

As further shown in FIG. 5, the insert 504 comprises an elongate strip of base support 516 having an upper surface 518 and a lower surface 520. The insert 504 further comprises a layer of artificial lawn 522 attached to the upper surface 518 of the base support 516. The artificial lawn 522 can be attached by adhesives, nails, bolts or other methods known in the art. In some implementations, the layer of artificial lawn 522 can be replaced by other types of artificial coverings such as those that simulate the look of pavers, stone works, cement or the like. In one embodiment, the insert 504 has an indent 524 that desirably extends along the length of at least one longitudinal side of the base support 516. Preferably, the indent 524 on the insert 504 is adapted to slidably engage with the overhang 514 on the crypt lid covering 502 in an interlocking manner such that the crypt lid covering and insert are joined together in a substantially abutting arrangement. The indent 524 is preferably sized to receive the overhang 514 in a manner such that the artificial lawns on the crypt lid covering and the insert are joined together in an abutting manner and are substantially flush with each other. In one embodiment, the width of the indent 524 is between about 0.1 inch to 1 inch or between about 0.5 inch to 2 inches. In another embodiment, the lower surface 520 of the insert 504 has a width of between about 2 to 4 inches and the upper surface 518 of the insert 504 has a width of between about 1 to 3 inches. However, it will be appreciated that the insert can assume a variety of different dimensions and configurations without departing from the scope of the invention. Preferably, the base support 516 of the insert 504 is also made of a rigid, plastic material, such as PVC, or other suitable materials known in the art.

In one implementation, the insert 504 is positioned between adjacent crypt lid coverings in a manner such that a longitudinal side edge 526 of the insert abuts a side edge 528 of the crypt lid covering 502. In one embodiment, the upper surface 518 of the insert 504 is substantially flush with the upper surface 508 of the crypt lid covering when the insert slidably engages with the crypt lid cover. The insert 504 can be slidably inserted between adjacent crypt lid coverings 502 via an interlocking mechanism such that the indent 524 on the insert 504 slidably engages with the overhang 514 on the crypt lid covering 502 and a lower longitudinal side edge 530 of the insert extends into a space 532 underneath the overhang 514 on the crypt lid covering, which substantially interlocks the insert 504 in place relative to adjacent crypt lid coverings and prevents the insert 504 from moving. When there is a need to remove one of the crypt lids, the insert 504 can be slid out from between adjacent crypt lid coverings so that lifting of one crypt lid would not affect the crypt lid coverings of adjacent crypts.

Figure 6:
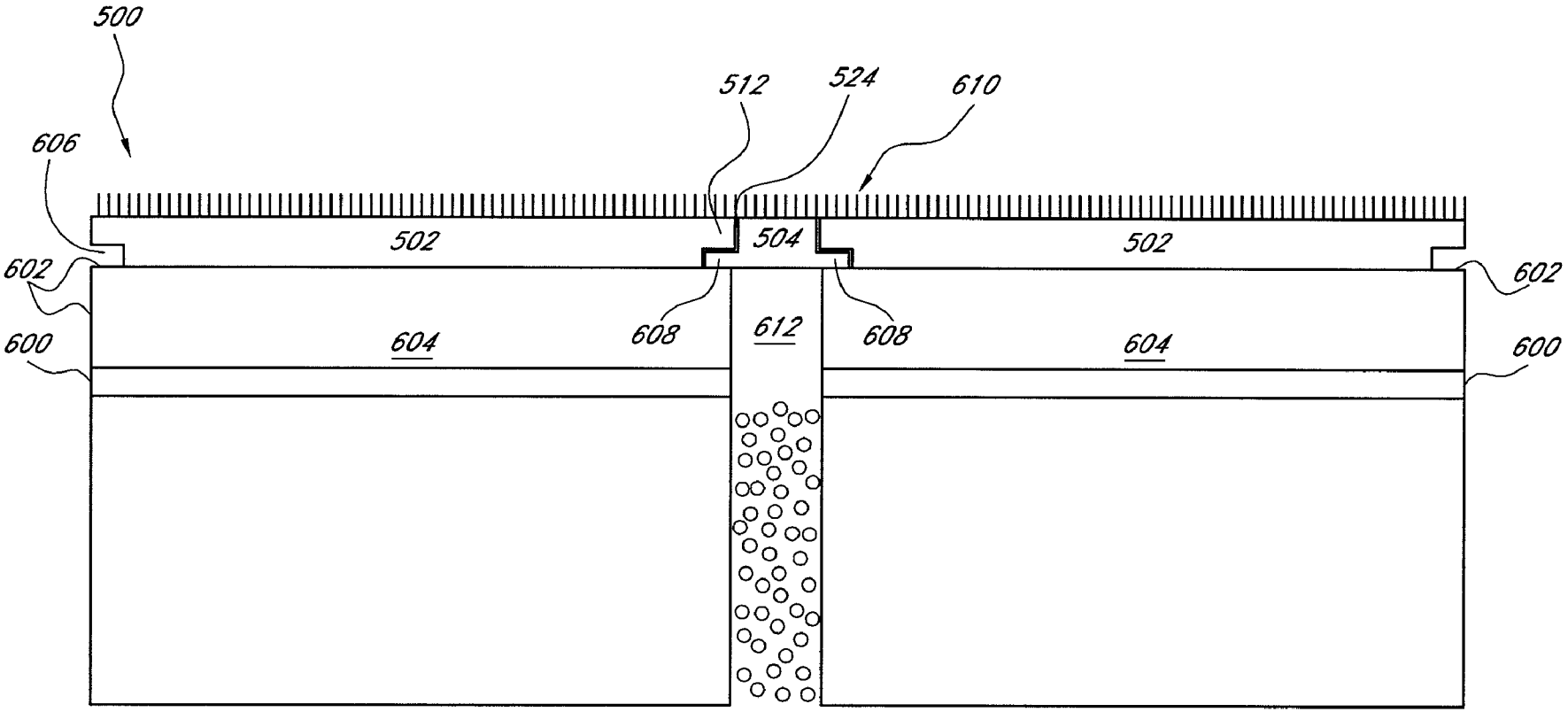
FIG. 6 is a cross-section view of the lawn crypt lid covering system of FIG. 5 when installed, showing the interlocking mechanism of one embodiment of the present invention.

FIG. 6 illustrates the manner in which the crypt lid covering system 500 of one preferred embodiment can be used to form a substantially continuous exterior covering over a plurality of conventional lawn crypts 600. As shown in FIG. 6, the crypt lid covering 502 is attached to an upper surface 602 of each crypt lid 604. The overhang 512 of each crypt lid covering 502 in combination with the upper surface 602 of the crypt lid 604 form a groove or channel 606 that is adapted to receive a lower longitudinal side edge 608 of the insert 504 while the overhang 512 is received in the indent 524 on the insert 504. As shown in FIG. 6, the insert 504 slidably engages with two adjacent crypt lid coverings 502 in a flush and abutting manner so as to form a substantially continuous exterior surface 610. In one embodiment, the exterior surface 610 comprises artificial lawn. In other embodiments not shown, the exterior surface above the insert 504 can comprise artificial pavers, stone-work, cement or the like so as to create the appearance of borders around individual crypts. Advantageously, the insert 504 is positioned over a gap 612 between crypts and engages with adjacent crypt lid coverings in an interlocking manner so as to form a stable support surface above the gap 612 between adjacent crypts. As such, people, especially women wearing high heel shoes, can walk between adjacent crypts without risking having the heel of the shoe getting caught in the gap 612 between adjacent crypts. Moreover, to remove one of the crypt lids, only the insert 504 is slid out from between adjacent crypt lid covers 502 and the coverings on adjacent crypts are not disturbed.

Figure 7:
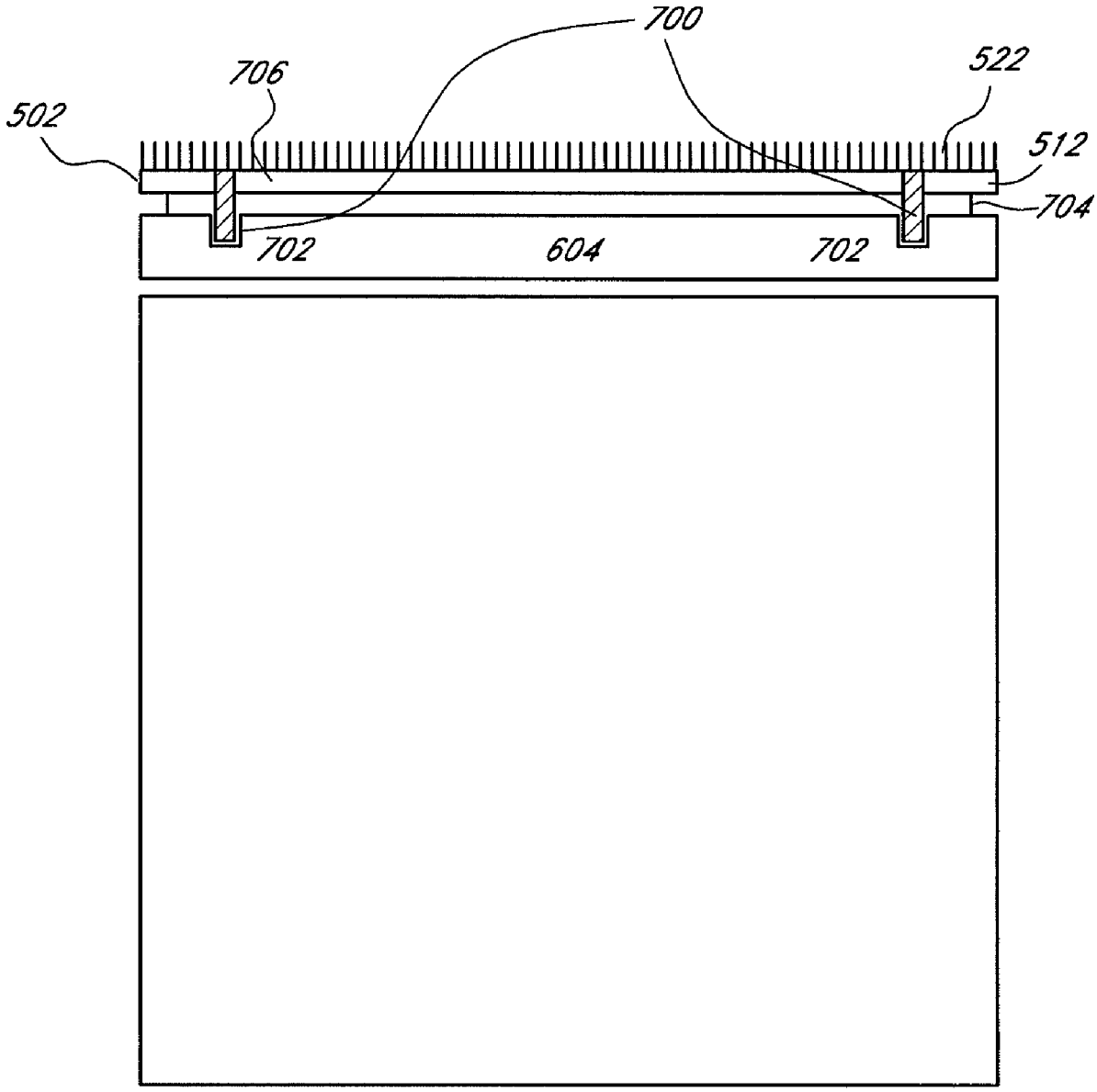
FIG. 7 schematically illustrates the manner in which the lawn crypt lid covering system of one embodiment is fastened to the crypt lid.

FIG. 7 illustrates the manner in which the crypt lid covering 502 of one embodiment is fastened to the crypt lid 604. As shown in FIG. 7, a plurality of fixing screws 700 extends through the crypt lid covering 502 and into drilled holes 702 in the crypt lid 604. In one embodiment, the fixing screws 700 comprise concrete screws. Other receiving recesses can also be formed in the crypt lid to receive the fixing screws. In this embodiment, the crypt lid covering 502 comprises two PVC Sintra boards 704, 706, one having a shorter width than the other so as to form the overhang 512. In alternate embodiments, the crypt lid covering 502 can comprise a single PVC Sintra board having pre-formed recessed areas along one or more edges. The layer of artificial lawn 522 is disposed on the upper surface of the PVC Sintra board 706.

Figure 8:
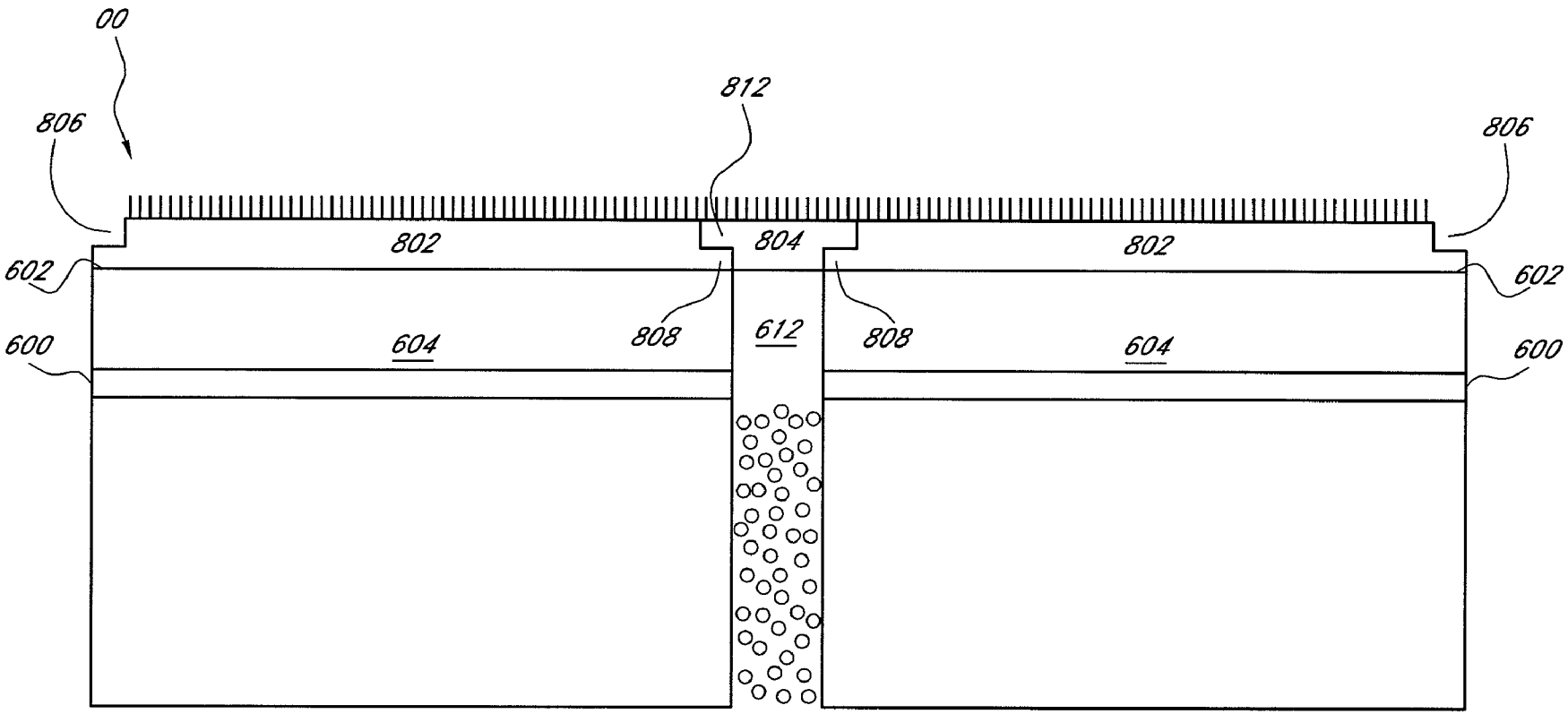
FIG. 8 is a cross-section view of the lawn crypt lid covering system of another embodiment, showing the interlocking mechanism of another embodiment.

FIG. 8 illustrates an alternative embodiment of a crypt lid covering system, which comprises an insert 804 having an overhang 812 and a plurality of crypt lid coverings 802, each having an indent 806 that desirably extends the length of each crypt lid covering. The insert 804 engages with the crypt lid coverings 802 when the overhangs 812 on the insert 804 are received into the indents 806 on adjacent crypt lid coverings. In some embodiments, the overhangs 812 on the insert are removably attached to a lower portion of the longitudinal side edge 808 of each crypt lid covering by adhesives, double-back tapes, nails, snap fasteners, hook and loop, and other known mechanisms, thus removably securing the insert between adjacent crypt lid coverings.

Figure 9:
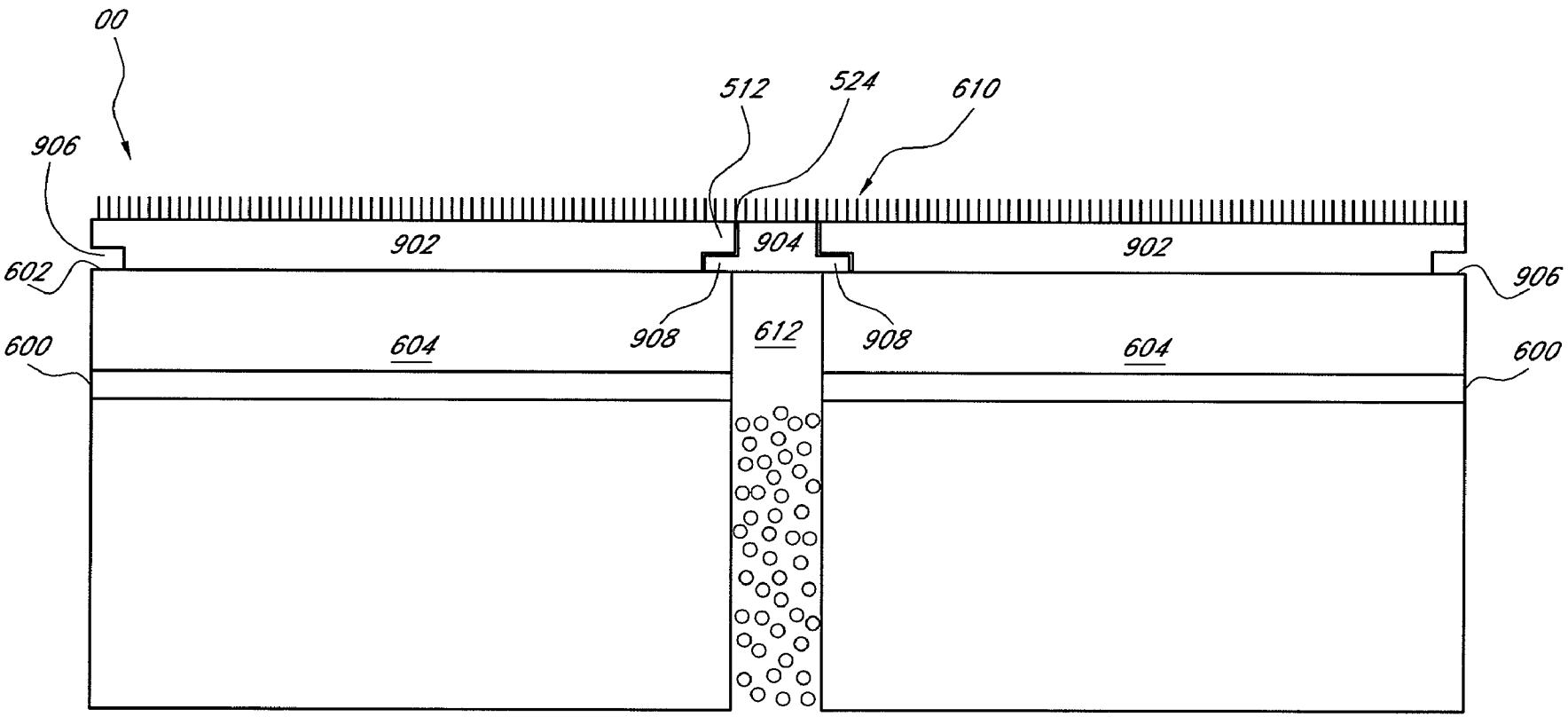
FIG. 9 is a cross-section view of the lawn crypt lid covering system of yet another embodiment, showing the interlocking mechanism of yet another embodiment.

FIG. 9 illustrates yet another alternative embodiment of a crypt lid covering system, which comprises a crypt lid covering 902 having grooves or channels 906 extending along the length of at least one side edge. The grooves can channels can be pre-formed in the board. The system further comprises an insert 904 having protrusions 908 extending along at least one side edge. The protrusions 908 on the insert 904 are adapted to be received in the grooves 906 on the crypt lid covering, thereby interlocking the insert with the crypt lid coverings. In certain other embodiments, the groove adapted to receive the protrusion on the insert can be formed on the crypt lid or can be formed by a side edge of the crypt lid covering and a recessed area on the crypt lid.

Figure 10:
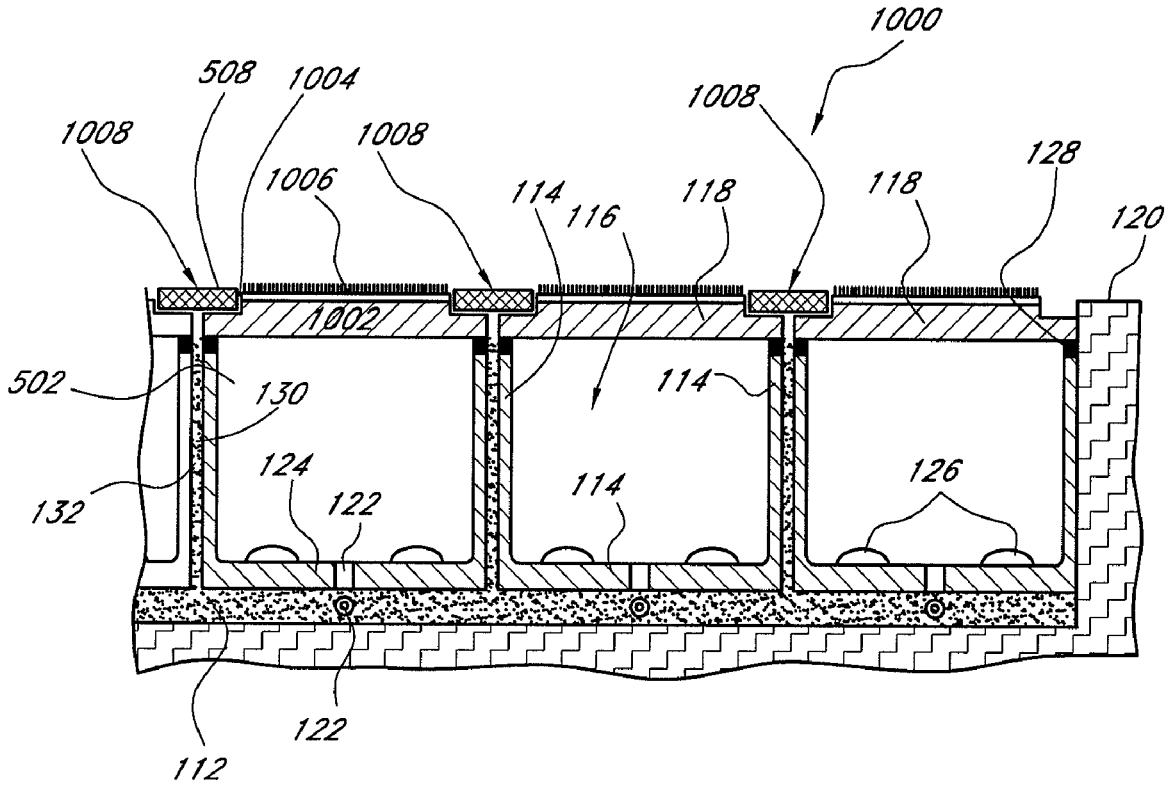
FIG. 10 is a cross-section view of the lawn crypt lid covering system of yet another embodiment.

FIG. 10 illustrates yet another embodiment of a crypt lid covering system 1000. The crypt lid covering system 1000 comprises a crypt lid 1002 having a recessed area 1004 extending along at least two opposing edges of the lid 1002. The crypt lid covering system 1000 further comprises a layer of artificial lawn 1006 that is disposed on an upper surface of the crypt lid. Preferably, the artificial lawn does not extend into the recessed area. In a preferred embodiment, pavers 1008, stone-work, cement, or the like are positioned in the recessed areas between crypts. Advantageously, the boundaries of each grave can thus be better defined in appearance.

The foregoing description of the preferred embodiment of the present invention has shown, described and pointed out the fundamental novel features of the invention. It will be understood that various omissions, substitutions, and changes in the form of the detail of the apparatus as illustrated as well as the uses thereof, may be made by those skilled in the art, without departing from the spirit of the invention. Consequently, the scope of the invention should not be limited to the foregoing discussions, but should be defined by appended claims.

What is claimed is:

1. A method of covering a plurality of lawn crypt lids, comprising:

positioning a lawn crypt lid covering on each of the plurality of the lawn crypt lids such that there is a space between two adjacent lawn crypt lid coverings, wherein each lawn crypt lid covering provides a groove that extends adjacent to at least one edge of the respective lawn crypt lid; and positioning an elongate insert in the space between the two adjacent lawn crypt lid coverings, wherein opposing longitudinal edges of the insert are inserted into the grooves of the two adjacent lawn crypt lid coverings so that the insert is substantially flush with the two adjacent lawn crypt lid coverings.

2. The method of claim 1, wherein at least one of the lawn crypt lid coverings comprises a plurality of cut-outs for grave markers.

3. The method of claim 1, wherein each lawn crypt lid covering comprises a layer of artificial lawn and the insert comprises a layer of artificial lawn.

4. The method of claim 1, wherein positioning a lawn crypt lid covering on each of the plurality of the lawn crypt lids comprises affixing a lawn crypt lid covering to each of the lawn crypt lids by fixing screws.

5. The method of claim 1, wherein each lawn crypt lid covering comprises a base support, wherein said base support is selected from the group consisting of fiberglass, FRP, PVC, ABS, and combinations thereof.

* * * * *